US012258840B1

(12) United States Patent
Al-Ghannam et al.

(10) Patent No.: US 12,258,840 B1
(45) Date of Patent: Mar. 25, 2025

(54) SUB-SURFACE SAFETY VALVE WITH ENERGY HARVESTING SYSTEM AND WIRELESS ACTIVATION

(71) Applicant: SAUDI ARABIAN OIL COMPANY, Dhahran (SA)

(72) Inventors: Abdullah K. Al-Ghannam, Al-Ahsa (SA); Sanjiv Kumar, Dhanbad (IN)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/457,935

(22) Filed: Aug. 29, 2023

(51) Int. Cl.
*E21B 34/16* (2006.01)
*E21B 34/06* (2006.01)
*E21B 41/00* (2006.01)

(52) U.S. Cl.
CPC ..... *E21B 34/16* (2013.01); *E21B 34/066* (2013.01); *E21B 41/0085* (2013.01); *E21B 2200/05* (2020.05)

(58) Field of Classification Search
CPC .... E21B 34/16; E21B 34/066; E21B 41/0085; E21B 2200/05
See application file for complete search history.

(56) References Cited

U.S. PATENT DOCUMENTS 3,780,809 A * 12/1973 Ayers, Jr. ..... E21B 34/16 166/374
4,119,146 A 10/1978 Taylor
4,852,648 A 8/1989 Akkerman et al.
5,358,035 A * 10/1994 Grudzinski ..... E21B 34/066 340/856.4
7,637,324 B2 12/2009 Anderson et al.
7,654,333 B2 2/2010 Smith
7,878,252 B2 2/2011 Smith et al.
9,334,708 B2 * 5/2016 Huang ..... E21B 34/08
10,670,160 B2 6/2020 Phelps
2015/0275620 A1 10/2015 Scott et al.

FOREIGN PATENT DOCUMENTS

EP 3 901 407 A1 10/2021
WO 2022/240621 A1 11/2022

* cited by examiner

*Primary Examiner* — D. Andrews
(74) *Attorney, Agent, or Firm* — Osha Bergman Watanabe & Burton LLP

(57) ABSTRACT

A subsurface safety valve includes an outer housing, a flapper valve disposed within the outer housing, and a motor that pivotally displaces the flapper valve. The subsurface safety valve also includes a battery that powers the motor, a turbine that charges the battery and a wireless receiver that, responsive to a received signal, transmits a signal to the motor to pivotally displace the flapper valve. A related method includes: providing a subsurface safety valve having an outer housing; disposing a flapper valve within the outer housing; providing a motor, a battery, a turbine and a wireless receiver; charging the battery with the turbine; powering the motor with the battery; receiving a signal at the wireless receiver; and responsive to the received signal, transmitting a signal to the motor to pivotally displace the flapper valve.

10 Claims, 8 Drawing Sheets

SUB-SURFACE SAFETY VALVE WITH ENERGY HARVESTING SYSTEM AND WIRELESS ACTIVATION

BACKGROUND

In the oilfield arts, a subsurface safety valve (SSSV) is often installed in a well upper completion, as a component of tubing which arrests well flow in the event of an emergency shut-down or blowout. Normally, an SSSV is controlled from a surface location and is actuated via signals transmitted via a control line. However, in the event of any damage to the control line or related malfunction, a complex workover operation is typically required for repairing the control line, in cases, and may even warrant removing and replacing the SSSV itself. Wireless control arrangements have been developed conventionally, but significant reliability issues are often encountered.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a subsurface safety valve that includes an outer housing, a flapper valve disposed within the outer housing, and a motor that pivotally displaces the flapper valve. The subsurface safety valve also includes a battery that powers the motor, a turbine that charges the battery and a wireless receiver that, responsive to a received signal, transmits a signal to the motor to pivotally displace the flapper valve.

In one aspect, embodiments disclosed herein relate to a method including: providing a subsurface safety valve having an outer housing; disposing a flapper valve within the outer housing; providing a motor, a battery, a turbine and a wireless receiver; charging the battery with the turbine; powering the motor with the battery; receiving a signal at the wireless receiver; and responsive to the received signal, transmitting a signal to the motor to pivotally displace the flapper valve.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
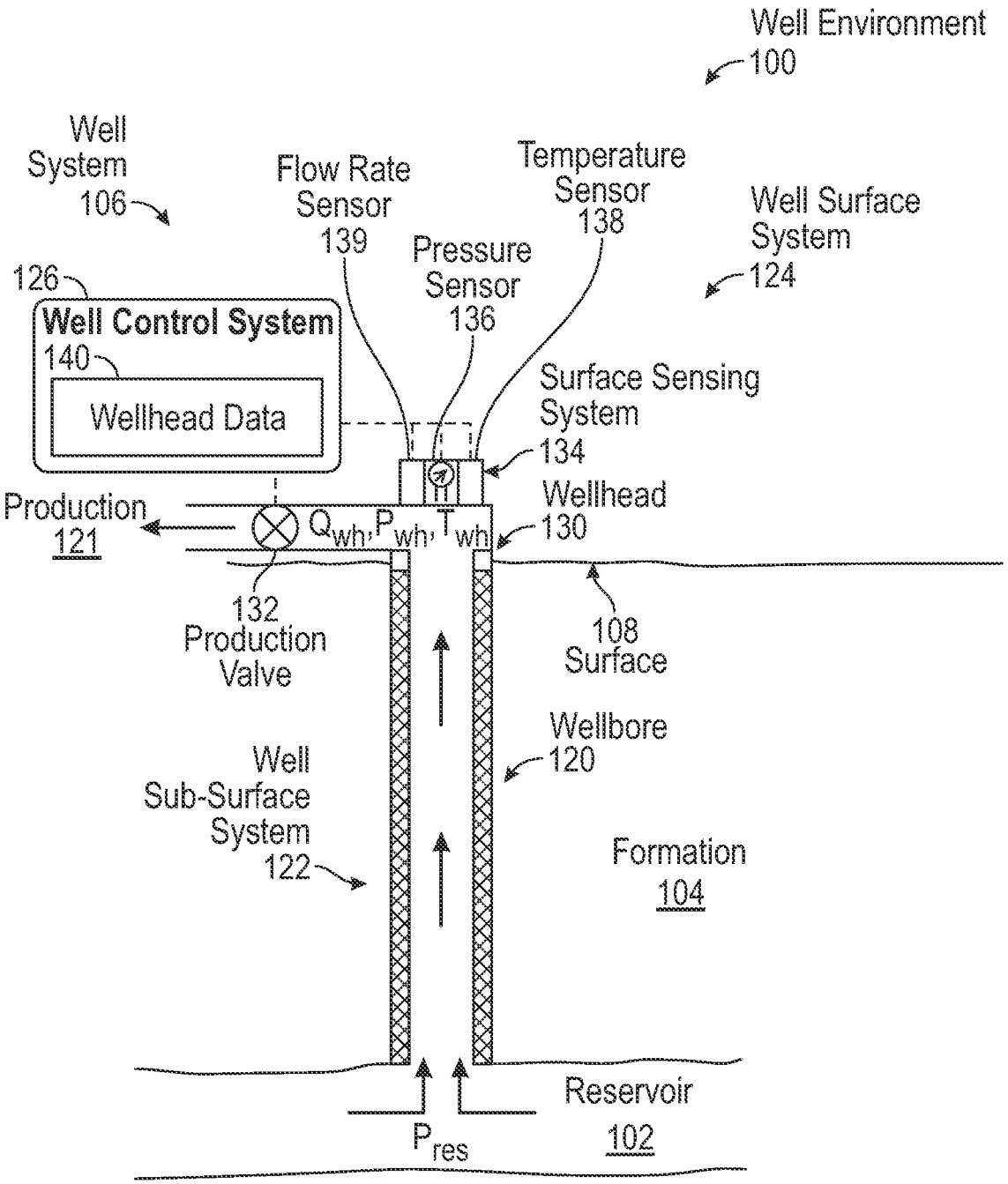
FIG. 1 schematically illustrates, in a cross-sectional elevational view, a conventional wellbore and well control system by way of general background and in accordance with one or more embodiments.
Figure 2:
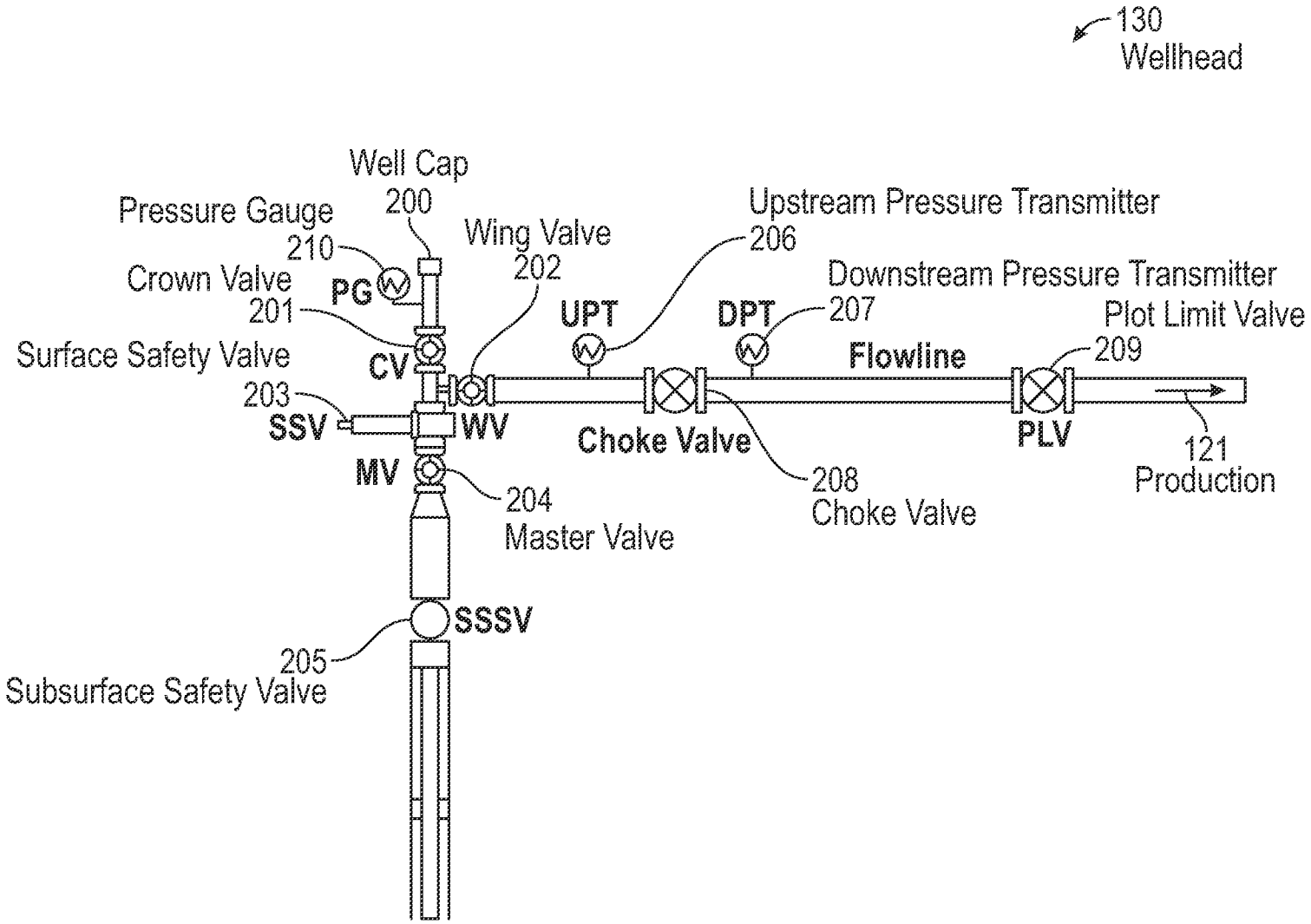
FIG. 2 illustrates, in elevational view, a wellhead, and related components, employed for the wellbore and well control system of FIG. 1, by way of general background and in accordance with one or more embodiments.

By way of general background in accordance with one or more embodiments, FIGS. 1 and 2 illustrate a general environment in which one or more embodiments may be employed. Thus, FIG. 1 schematically illustrates, in a cross-sectional elevational view, a wellbore and a well control system in accordance with one or more embodiments. The well system 106 includes a wellbore 120, a well sub-surface system 122, a well surface system 124, and a well control system ("control system") 126. The control system 126 may control various operations of the well system 106, such as well production operations, well completion operations, well maintenance operations, and reservoir monitoring, assessment and development operations. The control system 126 includes a computer system that can be the same as, or is in communication with, computer system 885 described below in FIG. 8.

In accordance with one or more embodiments, the wellbore 120 includes a bored hole that extends from the surface 108 into a target zone of the formation 104, such as the reservoir 102. An upper end of the wellbore 120, terminating at or near the surface 108, may be referred to as the "up-hole" end of the wellbore 120, and a lower end of the wellbore, terminating in the formation 104, may be referred to as the "down-hole" end of the wellbore 120. The wellbore 120 facilitates the circulation of drilling fluids during drilling operations, the flow of hydrocarbon production ("production") 121 (e.g., oil and gas) from the reservoir 102 to the surface 108 during production operations, the injection of substances (e.g., water) into the formation 104 or the reservoir 102 during injection operations, or the communication of monitoring devices (e.g., logging tools) into the formation 104 or the reservoir 102 during monitoring operations (e.g., during in situ logging operations).

In accordance with one or more embodiments, during operation of the well system 106, the control system 126 collects and records wellhead data 140 for the well system 106. The wellhead data 140 may include, for example, a record of measurements of wellhead pressure ($P_{wh}$) (e.g., including flowing wellhead pressure), wellhead temperature ($T_{wh}$) (e.g., including flowing wellhead temperature), wellhead production rate ($Q_{wh}$) over some or all of the life of the well 106, and water cut data. Such measurements may be recorded in real-time, to be available for review or use within seconds, minutes, or hours of the condition being sensed (e.g., within one hour). Such real-time data can help an operator of the well 106 to assess a relatively current state of the well system 106, and make real-time decisions regarding development of the well system 106 and the reservoir 102, such as on-demand adjustments in regulation of production flow from the well.

In accordance with one or more embodiments, the well sub-surface system 122 includes a casing installed in the wellbore 120. For example, the wellbore 120 may have a cased portion and an uncased (or "open-hole") portion. The cased portion may include a portion of the wellbore having casing (e.g., casing pipe and casing cement; see, e.g., 342 in FIG. 3) disposed therein. The uncased portion may include a portion of the wellbore not having casing disposed therein. In embodiments having a casing, the casing defines a central passage that provides a conduit for the transport of tools and substances through the wellbore 120. For example, the central passage may provide a conduit for lowering logging tools into the wellbore 120, a conduit for the flow of production 121 (e.g., oil and gas) from the reservoir 102 to the surface 108, or a conduit for the flow of injection substances (e.g., water) from the surface 108 into the formation 104. The well sub-surface system 122 can include production tubing installed in the wellbore 120. The production tubing may provide a conduit for the transport of tools and substances through the wellbore 120. The production tubing may, for example, be disposed inside casing. In such an embodiment, the production tubing may provide a conduit for some or all of the production 121 (e.g., oil and gas) passing through the wellbore 120 and the casing.

In accordance with one or more embodiments, the well surface system 124 includes a wellhead 130. The wellhead 130 may include a rigid structure installed at the "up-hole" end of the wellbore 120, at or near where the wellbore 120 terminates at the Earth's surface 108. The wellhead 130 may include structures (called "wellhead casing hanger" for casing and "tubing hanger" for production tubing) for supporting (or "hanging") casing and production tubing extending into the wellbore 120. Production 121 may flow through the wellhead 130, after exiting the wellbore 120 and the well sub-surface system 122, including, for example, the casing and the production tubing. The well surface system 124 may include flow regulating devices that are operable to control the flow of substances into and out of the wellbore 120. For example, the well surface system 124 may include one or more production valves 132 that are operable to control the flow of production 121. For instance, a production valve 132 may be fully opened to enable unrestricted flow of production 121 from the wellbore 120, the production valve 132 may be partially opened to partially restrict (or "throttle") the flow of production 121 from the wellbore 120, and production valve 132 may be fully closed to fully restrict (or "block") the flow of production 121 from the wellbore 120, and through the well surface system 124.

In accordance with one or more embodiments, the wellhead 130 includes a choke assembly. For example, the choke assembly may include hardware with functionality for opening and closing the fluid flow through pipes in the well system 106. Likewise, the choke assembly may include a pipe manifold that may lower the pressure of fluid traversing the wellhead. As such, the choke assembly may include set of high pressure valves and at least two chokes. These chokes may be fixed or adjustable or a mix of both. Redundancy may be provided so that if one choke has to be taken out of service, the flow can be directed through another choke. In some embodiments, pressure valves and chokes are communicatively coupled to the well control system 126. Accordingly, a well control system 126 may obtain wellhead data regarding the choke assembly as well as transmit one or more commands to components within the choke assembly in order to adjust one or more choke assembly parameters.

In accordance with one or more embodiments, the well surface system 124 includes a surface sensing system 134. The surface sensing system 134 may include sensors for sensing characteristics of substances, including production 121, passing through or otherwise located in the well surface system 124. The characteristics may include, for example, pressure, temperature and flow rate of production 121 flowing through the wellhead 130, or other conduits of the well surface system 124, after exiting the wellbore 120.

In accordance with one or more embodiments, the surface sensing system 134 includes a surface pressure sensor 136 operable to sense the pressure of production 121 flowing through the well surface system 124, after it exits the wellbore 120. The surface pressure sensor 136 may include, for example, a wellhead pressure sensor that senses a pressure of production 121 flowing through or otherwise located in the wellhead 130. In some embodiments, the surface sensing system 134 includes a surface temperature sensor 138 operable to sense the temperature of production 121 flowing through the well surface system 124, after it exits the wellbore 120. The surface temperature sensor 138 may include, for example, a wellhead temperature sensor that senses a temperature of production 121 flowing through or otherwise located in the wellhead 130, referred to as "wellhead temperature" ($T_{wh}$). In some embodiments, the surface sensing system 134 includes a flow rate sensor 139 operable to sense the flow rate of production 121 flowing through the well surface system 124, after it exits the wellbore 120. The flow rate sensor 139 may include hardware that senses a flow rate of production 121 ($Q_{wh}$) passing through the wellhead 130.

FIG. 2 illustrates, in elevational view, a wellhead, and related components, employed for the wellbore and well control system of FIG. 1, in accordance with one or more embodiments. As such, one or more of the modules and/or elements shown in FIG. 2 may be omitted, repeated, and/or substituted. Accordingly, embodiments of the invention should not be considered limited to the specific arrangements of modules and/or elements shown in FIG. 2.

In accordance with one or more embodiments, FIG. 2 illustrates details of the wellhead 130 and the flowline for the production 121 depicted in FIG. 1 above. As shown, the wellhead 130 includes a well cap 200, a crown valve 201, a wing valve 202, a surface safety valve 203, a master valve 204, a subsurface safety valve 205, an upstream pressure transmitter 206, a downstream pressure transmitter 207, a choke valve 208, and a plot limit valve 209. The crown valve 201, wing valve 202, surface safety valve 203, master valve 204, choke valve 208, and plot limit valve 209 are referred to as valves at the wellhead. In addition, a pressure gauge 210 and/or temperature gauge (not shown) is permanently installed between the crown valve 201 and the well cap 200. The pressure gauge 210 and/or temperature gauge (not shown) correspond to the pressure sensor 136 and temperature sensor 138, respectively, depicted in FIG. 1 above.

In accordance with one or more embodiments, the well cap 200 provides access to wellbore for interventions with wireline, coil tubing, slickline etc. The crown valve 201 is the uppermost valve on wellhead. Typically, the crown valve 201 is closed until there is a need to access the well as described above. The wing valve 202 is for production flow control. In the case of needing to enter a well, this valve would be closed and the master valve would be open. The surface safety valve 203 is typically a hydraulic failsafe close valve located at surface. The surface safety valve 203 used in the event of an issue in the wellbore/surface equipment and for testing. The master valve 204 is the main valve controlling flow from the wellbore. The subsurface safety valve 205 is another safety device located below the surface, e.g., several hundred plus feet below the surface. The subsurface safety valve 205 makes up part of the production tubing and provides an arrangement for safety closure in the case of uncontrolled release of hydrocarbons, such as a kick. Also, the subsurface safety valve 205 may be used as a barrier when testing or needed to perform maintenance on the wellhead.

In accordance with one or more embodiments, the choke valve 208 is used for flow restriction in the event of bleeding down pressure during testing, loss of pressure in the wellbore, temperature management, etc. The upstream pressure transmitter 206 is a pressure/temperature gauge located upstream of choke valve 208 and provides pressure data prior to reaching the choke valve 208. The downstream pressure transmitter 207 is a pressure/temperature gauge downstream of choke valve 208 and provides pressure data after passing the choke valve 208. The plot limit valve 209 is a valve for testing, maintenance and isolation purposes, e.g., if the upstream pressure transmitter 206, downstream pressure transmitter 207, or choke valve 208 were being replaced. The pressure gauge 210 located above the crown valve 201 is for testing each component of the wellhead. As generally treated herein, shut-in wellhead pressure (SIWHP) refers to the initial wellhead pressure from the reservoir as seen at surface and is a base line pressure for testing purposes, and can be measured by the pressure gauge 210. The initial manifold pressure refers to the initial pressure downstream of wellhead and is a base line pressure for testing purposes.

In one or more embodiments, the hydraulic valves and associated gauges are connected as depicted in FIG. 2. In particular, a pressure gauge 210 can be permanently installed between the well cap 200 and the crown valve 201. In a first open/close configuration, the subsurface safety valve, master valve, wellhead valve, crown valve, and plot limit valve are closed to record the initial manifold pressure using the downstream pressure transmitter.

In accordance with one or more embodiments, following the first open/close configuration and in the second open/close configuration, the subsurface safety valve, master valve, wing valve, and crown valve are opened with the plot limit valve closed to record the initial shut-in wellhead pressure (SIWHP) using the permanently installed pressure gauge between the well cap and the crown valve. The pressure gauge readings of the permanently installed pressure gauge, the upstream pressure transmitter, and the downstream pressure transmitter are compared with each other to validate gauge accuracy. The gauge readings from the downstream pressure transmitter, the upstream pressure transmitter, and the pressure gauge between the well cap and the crown valve are denoted as DPT, UPT, and PG, respectively. All pressure gauge readings are observed for 10 minutes to record pressure changes, if any. If all three following conditions are true over the 10 minutes period: DPT=SIWHP, UPT=SIWHP, and PG=SIWHP, then the plot limit valve is determined as holding (i.e., no leakage).

Following the second open/close configuration and in the third open/close configuration, the wellhead valve is closed and the plot limit valve is opened to observe all pressure gauge readings for 10 minutes and record pressure changes, if any. If both following conditions are true over the 10 minutes period: UPT=initial manifold pressure=DPT and PG=SIWHP, then the wellhead valve is determined as holding (i.e., no leakage).

Following the third open/close configuration and in the fourth open/close configuration, the crown valve is closed followed by closing the master valve and opening the wellhead valve. If both following conditions are true over the 10 minutes period: UPT=initial manifold pressure=DPT and PG=SIWHP, then the crown valve and the master valve are determined as holding (i.e., no leakage).

Subsequent to the first, second, third and fourth open/close configurations, the crown valve is opened to bleed the pressure to a flare pit. Specifically, PLV and WV are open. MV is closed and CV bleeds the trapped pressure between CV and MV into the flare pit.

The disclosure now turns to working examples of a system and method in accordance with one or more embodiments, as described and illustrated with respect to FIGS. 3-8. It should be understood and appreciated that these merely represent illustrative examples, and that a great variety of possible implementations are conceivable within the scope of embodiments as broadly contemplated herein.

Broadly described and contemplated herein, in accordance with one or more embodiments, is a sub-surface safety valve (SSSV) equipped with a downhole energy harvesting system and wireless activation mechanism. Thus, the wireless activation mechanism can be utilized instead of a conventional hard-wired connection involving one or more control lines connected to equipment at a terrestrial surface, while the same can be powered locally to ensure longer-term reliability. Particularly, the SSSV may utilize well production flow to generate electrical power via a built-in turbine, and thereby charge a battery that powers the SSSV assembly.

Figure 3:
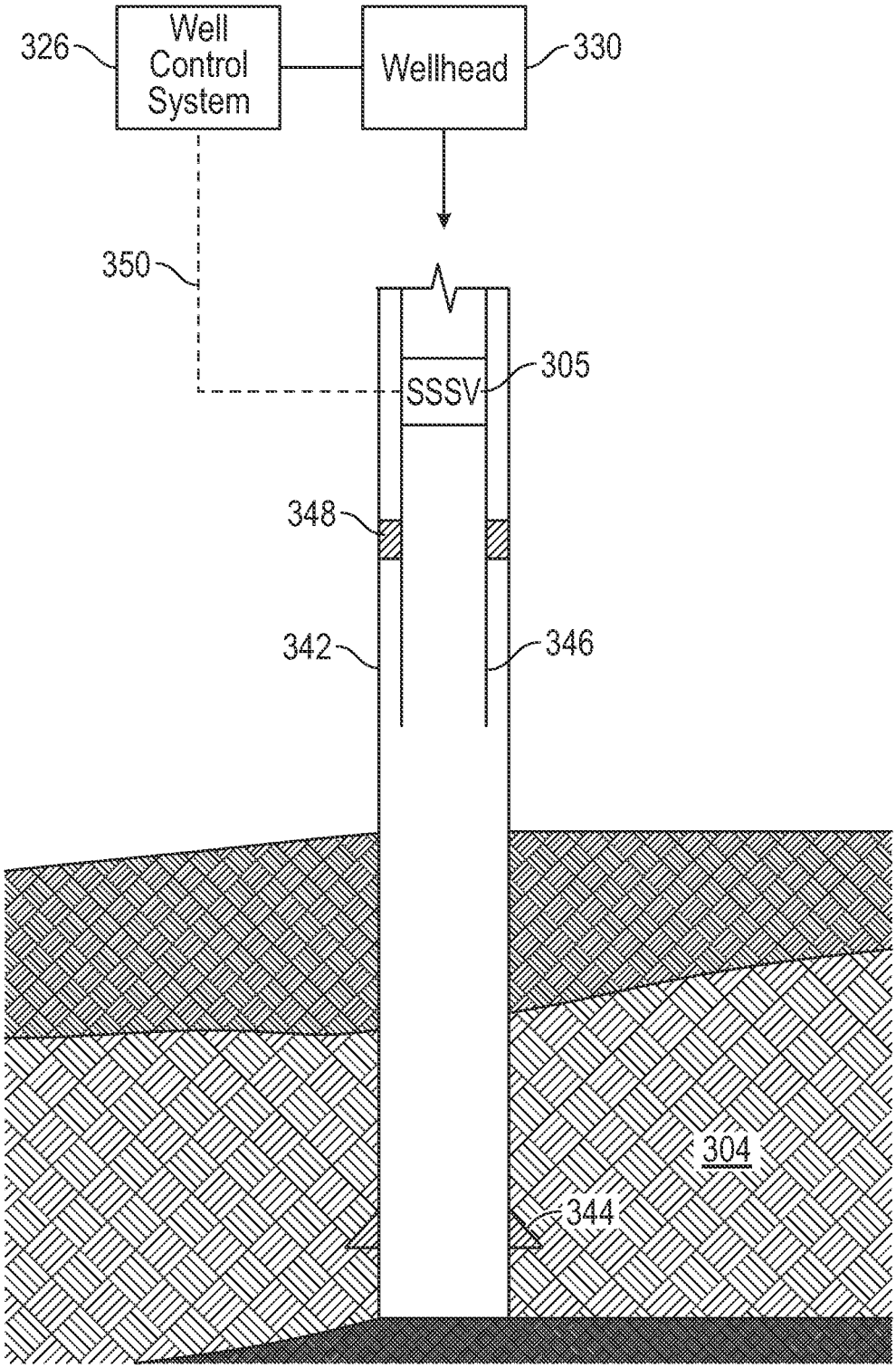
FIG. 3 schematically illustrates, in a cross-sectional elevational view, a production wellbore in accordance with one or more embodiments.

FIG. 3 schematically illustrates, in a cross-sectional elevational view, a production wellbore in accordance with one or more embodiments. In the illustrated working example, a well has been drilled and completed for oil production, with a casing 342 cemented into place and a casing shoe 344 set across formation rock 304 at a predetermined depth. Production tubing 346, for recovering hydrocarbons from the formation rock 304 (or other subsurface regions), is then installed and nested coaxially within the casing 342. Further, as is generally known, a packer 348 may be included to seal the annular chamber between the casing 342 and production tubing 346. Also illustrated is a wellhead 330 in communication with a well control system 326; these may function and be configured analogously to the wellhead 130 and well control system 126, respectively, that are described and illustrated with respect to FIGS. 1-2.

Also illustrated in FIG. 3 is an SSSV 305 provided in accordance with one or more embodiments. Generally, SSSV 305 may be located and may function analogously with respect to the SSSV 205 described and illustrated with respect to FIG. 2. Additionally, communication between the well control system 326 and SSSV 305 may be afforded by a wireless link schematically indicated at 350, and will be better understood and appreciated from the ensuing discussion herebelow.

Figure 4:
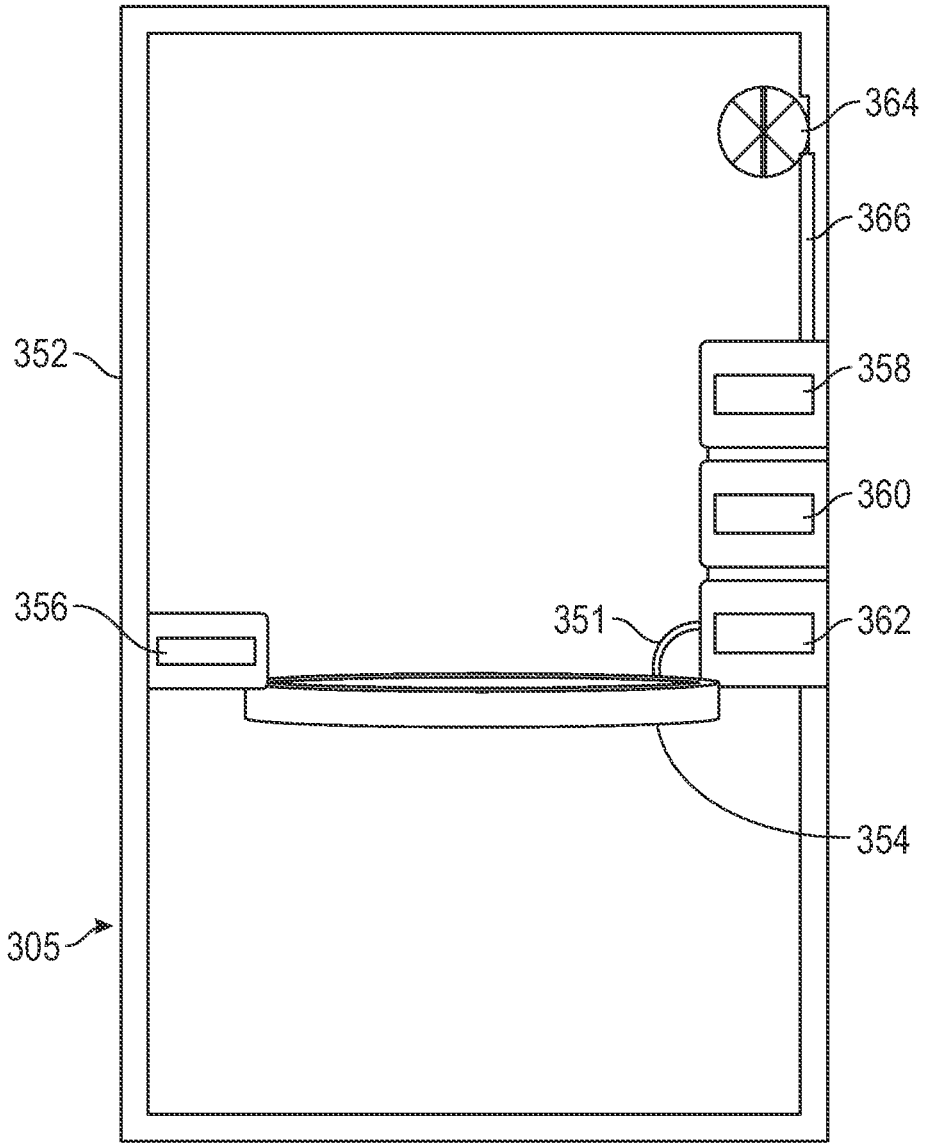
FIG. 4 schematically illustrates, in elevational view, the SSSV from FIG. 3 and related components, in accordance with one or more embodiments.

FIG. 4 schematically illustrates, in elevational view, the SSSV 305 from FIG. 3 and related components, in accordance with one or more embodiments. As shown, the SSSV 305 may include an outer housing 352 with a flapper valve 354 disposed therewithin. The valve 354 is mounted to pivot via a rotationally displaceable arm 351, while stop 356 is provided to arrest movement of the valve 354 in a clockwise direction (with respect to FIG. 4) and to provide a seal. Additionally, mounted axially adjacent to one another along an inner cylindrical surface of the housing 352 are a wireless receiver 358, a battery 360 and a motor 362. The arm 351 is mounted at motor 362 and is driven by the motor 362 in a manner to pivotally displace valve 354. Further, the battery 360 is connected to the motor 362 in a manner to power the motor 362.

In accordance with one or more embodiments, a suitable turbine 364 may also be mounted at the inner cylindrical surface of housing 352, axially spaced apart from receiver 358, battery 360 and motor 362. Further, a wired connection 366 may be provided to connect the turbine 364 with receiver 358 and battery 360, such that the turbine 364 can charge the receiver 358 and battery 360. In accordance with one or more variants, a wireless charger may be run downhole on an e-line (electric cable) to charge the receiver 358 and/or battery 360 in the event either loses power or becomes drained from inactivity of the turbine 364 (e.g., after a relatively long period of well shut-in).

Figure 5:
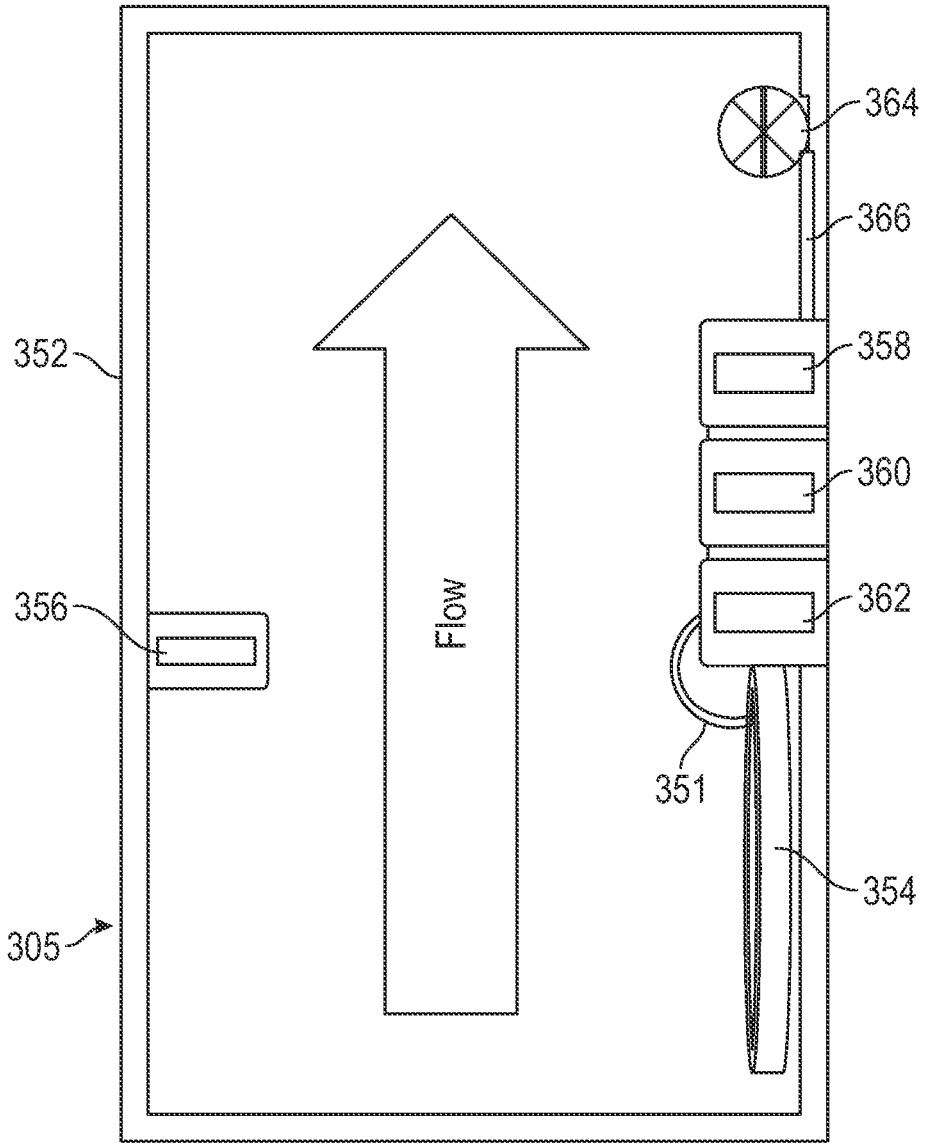
FIG. 5 provides essentially the same view as FIG. 4, but schematically illustrates operation with the flapper valve from FIG. 4 being open, in accordance with one or more embodiments.

FIG. 5 provides essentially the same view as FIG. 4, but schematically illustrates operation with the flapper valve 354 from FIG. 4 being open, in accordance with one or more embodiments. Thus, the valve 354 here is shown after undergoing pivotal displacement in a counterclockwise direction (with respect to FIG. 5) via arm 351. In order to so actuate the valve 354, the receiver 358 may wirelessly receive a signal from a surface location, such as from the well control system 326 shown in FIG. 3. The wireless signal may be sent via electromagnetic waves or any of a variety of other types of wireless waves. A related prompt to transmit the signal may be provided by a user, e.g., at a user interface associated with the well control system 326 shown in FIG. 3, or the computer 885 shown in FIG. 8. The receiver 358 may then relay or transmit a suitable signal to motor 362 such that the motor 362 actuates or drives the arm 351 to displace and open the valve 354.

In accordance with one or more embodiments, as the valve 354 remains open during well production, the uphole flow of reservoir fluid (indicated via the central arrow) will power the turbine 364, and thus permit the turbine 364 to recharge the receiver 358 and battery 360. It should be appreciated that any of a wide variety of possible turbines 364 may be utilized here. The type, size and selection of turbine 364 can be considered on the basis of a wide variety of factors, including predicated well performance and bubble point, in the context of prospective flow regimes.

Figure 6:
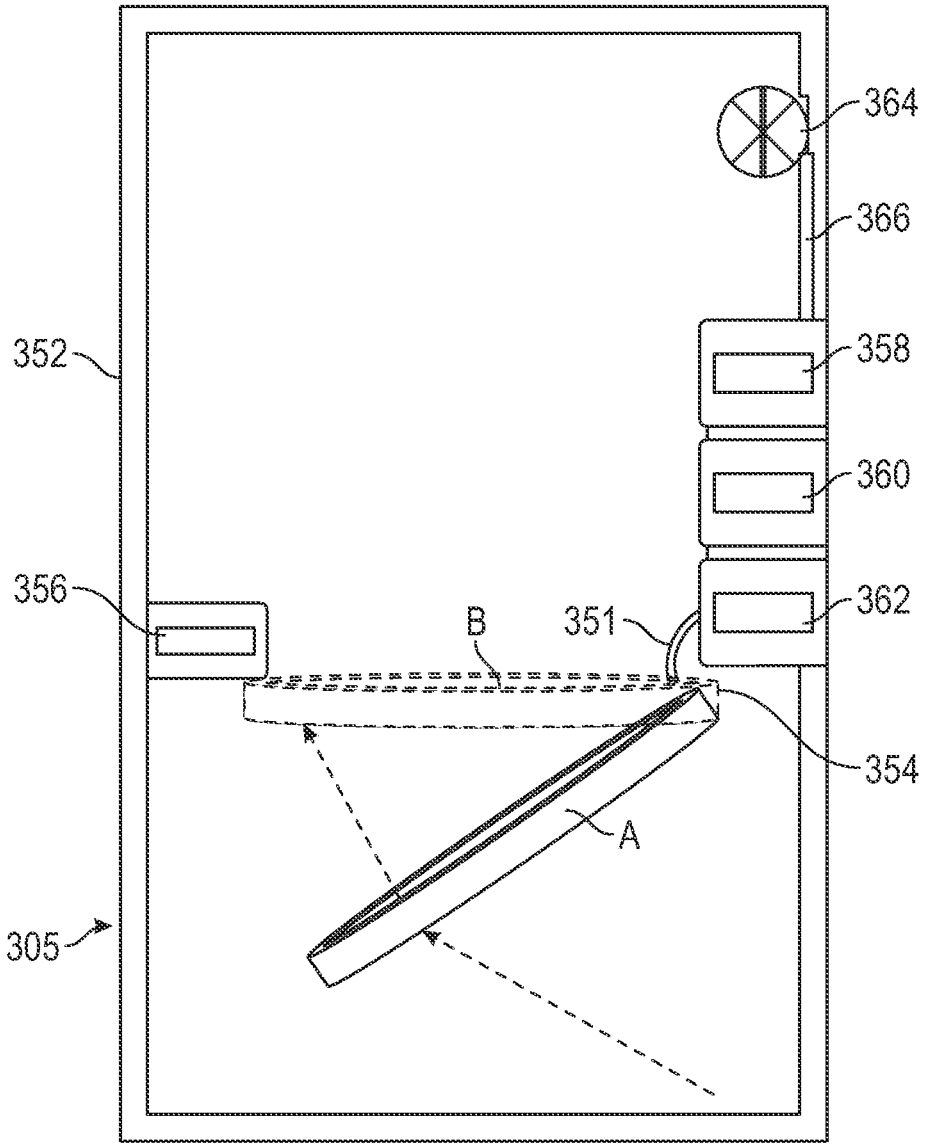
FIG. 6 provides essentially the same view as FIGS. 4 and 5, but schematically illustrates the closing of the flapper valve from FIGS. 4 and 5, in accordance with one or more embodiments.

FIG. 6 provides essentially the same view as FIGS. 4 and 5, but schematically illustrates the closing of the flapper valve 354 from FIGS. 4 and 5, in accordance with one or more embodiments. Particularly, the valve 354 is shown pivotally displacing, generally in the direction of the dotted arrows, to an intermediate position A and then to a fully closed and sealed position B. Thus, in order to so actuate the valve 354, the receiver 358 may receive a signal from a surface location, such as from the well control system 326 shown in FIG. 3. A related prompt to transmit the signal may be provided by a user, e.g., at a user interface associated with the well control system 326 shown in FIG. 3, or the computer 885 shown in FIG. 8. The receiver 358 may then relay or transmit a suitable signal to motor 362 such that the motor 362 actuates arm 351 to displace and close the valve 354.

In accordance with one or more embodiments, the signal to close the valve 354 may be manually transmitted as just noted or may be automatically transmitted. In either case, the signal may be transmitted in response to emergency conditions detected or experienced at the surface or detected or experienced in the wellbore. By way of illustrative example, a surface leak due to a pinhole leak or other physical damage to the flowline (e.g., by errantly performing equipment) may represent such an emergency condition. A resultant pressure drop may then trigger the signal to close the valve 354. Additionally, the valve 354 can be closed manually if used as a barrier, wherein a manually actuated signal can be transmitted from the terrestrial surface.

Figure 7:
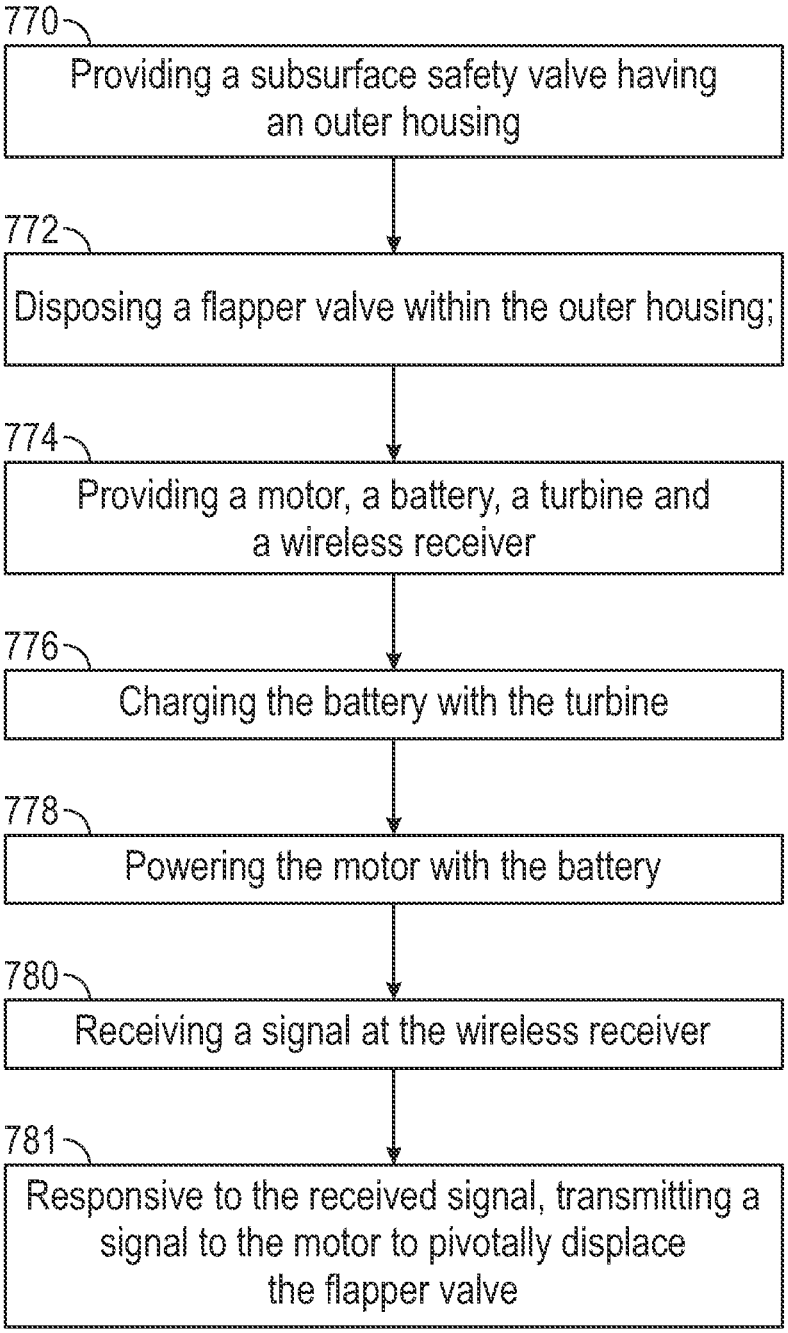
FIG. 7 shows a flowchart of a method in accordance with one or more embodiments.

FIG. 7 shows a flowchart of a method, as a general overview of steps which may be carried out in accordance with one or more embodiments described or contemplated herein. Specifically, FIG. 7 describes a method of operating a SSSV. One or more blocks in FIG. 7 may be performed using one or more components as described in FIGS. 1-6 and 8. While the various blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

As such, in accordance with one or more embodiments, a subsurface safety valve having an outer housing is provided (Step 770); this can correspond to the outer housing 352 described and illustrated with respect to FIGS. 4-6. A flapper valve is disposed within the housing (Step 772), and a motor, a battery, a turbine and a wireless receiver are provided (Step 774). These components can correspond to the flapper valve 354, motor 362, battery 360, turbine 364 and wireless receiver 358 described and illustrated with respect to FIGS. 4-6. The battery is charged with the turbine (Step 776) and the motor is powered with the battery (Step 778); these steps can be appreciated from FIGS. 4 and 5 and their related discussion herein. A signal is received at the wireless receiver (Step 780) and, responsive to the received signal, a signal is transmitted to the motor to pivotally displace the flapper valve (Step 781); these steps can be appreciated from FIGS. 5 and 6 and their related discussion herein.

It can be appreciated from the foregoing that, in accordance with one or more embodiments, solutions as broadly contemplated herein can avoid any and all disadvantages normally associated with the use of hard-wired control lines for SSSVs and with powering SSSVs that may otherwise be wirelessly controlled. Workover or other costly interventions can be avoided, especially to the benefit of populated areas with numerous operating wells and associated SSSVs.

Figure 8:
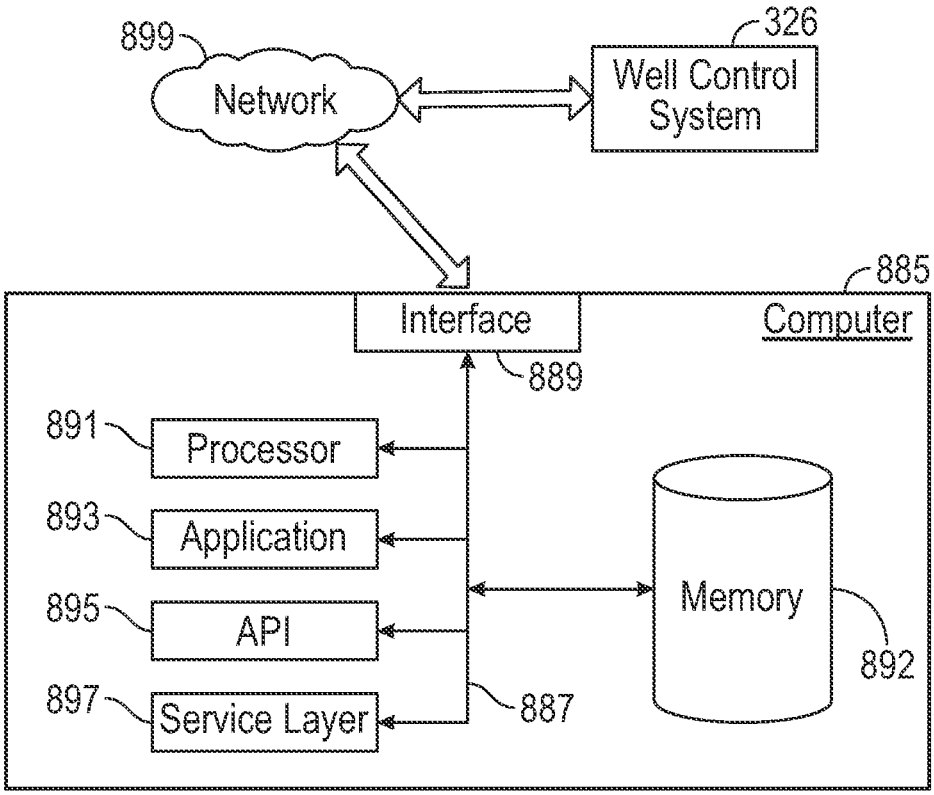
FIG. 8 schematically illustrates a computing device and related components, in accordance with one or more embodiments.

FIG. 8 schematically illustrates a computing device and related components, in accordance with one or more embodiments. As such, FIG. 8 generally depicts a block diagram of a computer system 885 used to provide computational functionalities associated with described algorithms, methods, functions, processes, flows, and procedures as described in this disclosure, according to one or more embodiments. In this respect, computer 885 may interface with a well control system 326 such as that described and illustrated with respect to FIG. 3, either directly (e.g., via hard-wired connection) or over an internal or external network 899. Alternatively, the computer 885 illustrated in FIG. 8 may correspond directly to the well control system 326 described and illustrated with respect to FIG. 3.

In accordance with one or more embodiments, the illustrated computer 885 is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer 885 may include a computer that includes an input device, such as a keypad, keyboard, touch screen, or other device that can accept user information, and an output device that conveys information associated with the operation of the computer 885, including digital data, visual, or audio information (or a combination of information), or a GUI.

The computer 885 can serve in a role as a client, network component, a server, a database or other persistency, or any other component (or a combination of roles) of a computer system for performing the subject matter described in the instant disclosure. The illustrated computer 885 is communicably coupled with a network 899. In some implementations, one or more components of the computer 885 may be configured to operate within environments, including cloud-computing-based, local, global, or other environment (or a combination of environments).

At a high level, the computer 885 is an electronic computing device operable to receive, transmit, process, store, or manage data and information associated with the described subject matter. According to some implementations, the computer 885 may also include or be communicably coupled with an application server, e-mail server, web server, caching server, streaming data server, business intelligence (BI) server, or other server (or a combination of servers).

The computer 885 can receive requests over network 899 from a client application (for example, executing on another computer 885) and responding to the received requests by processing the said requests in an appropriate software application. In addition, requests may also be sent to the computer 885 from internal users (for example, from a command console or by other appropriate access method), external or third-parties, other automated applications, as well as any other appropriate entities, individuals, systems, or computers.

Each of the components of the computer 885 can communicate using a system bus 887. In some implementations, any or all of the components of the computer 885, both hardware or software (or a combination of hardware and software), may interface with each other or the interface 889 (or a combination of both) over the system bus 887 using an application programming interface (API) 895 or a service layer 897 (or a combination of the API 895 and service layer 897. The API 895 may include specifications for routines, data structures, and object classes. The API 895 may be either computer-language independent or dependent and refer to a complete interface, a single function, or even a set of APIs. The service layer 897 provides software services to the computer 885 or other components (whether or not illustrated) that are communicably coupled to the computer 885. The functionality of the computer 885 may be accessible for all service consumers using this service layer. Software services, such as those provided by the service layer 897, provide reusable, defined business functionalities through a defined interface. For example, the interface may be software written in JAVA, C++, or other suitable language providing data in extensible markup language (XML) format or another suitable format. While illustrated as an integrated component of the computer 885, alternative implementations may illustrate the API 895 or the service layer 897 as stand-alone components in relation to other components of the computer 885 or other components (whether or not illustrated) that are communicably coupled to the computer 885. Moreover, any or all parts of the API 895 or the service layer 897 may be implemented as child or sub-modules of another software module, enterprise application, or hardware module without departing from the scope of this disclosure.

The computer 885 includes an interface 889. Although illustrated as a single interface 889 in FIG. 8, two or more interfaces 889 may be used according to particular needs, desires, or particular implementations of the computer 885. The interface 889 is used by the computer 885 for communicating with other systems in a distributed environment that are connected to the network 899. Generally, the interface 889 includes logic encoded in software or hardware (or a combination of software and hardware) and operable to communicate with the network 899. More specifically, the interface 889 may include software supporting one or more communication protocols associated with communications such that the network 899 or interface's hardware is operable to communicate physical signals within and outside of the illustrated computer 885.

The computer 885 includes at least one computer processor 891. Although illustrated as a single computer processor 891 in FIG. 8, two or more processors may be used according to particular needs, desires, or particular implementations of the computer 885. Generally, the computer processor 891 executes instructions and manipulates data to perform the operations of the computer 885 and any algorithms, methods, functions, processes, flows, and procedures as described in the instant disclosure.

The computer 885 also includes a memory 892 that holds data for the computer 885 or other components (or a combination of both) that can be connected to the network 899. For example, memory 892 can be a database storing data consistent with this disclosure. Although illustrated as a single memory 892 in FIG. 8, two or more memories may be used according to particular needs, desires, or particular implementations of the computer 885 and the described functionality. While memory 892 is illustrated as an integral component of the computer 885, in alternative implementations, memory 892 can be external to the computer 885.

The application 893 is an algorithmic software engine providing functionality according to particular needs, desires, or particular implementations of the computer 885, particularly with respect to functionality described in this disclosure. For example, application 893 can serve as one or more components, modules, applications, etc. Further, although illustrated as a single application 893, the application 893 may be implemented as multiple applications 893 on the computer 885. In addition, although illustrated as integral to the computer 885, in alternative implementations, the application 893 can be external to the computer 885.

There may be any number of computers 885 associated with, or external to, a computer system containing computer 885, wherein each computer 885 communicates over network 899. Further, the term "client," "user," and other appropriate terminology may be used interchangeably as appropriate without departing from the scope of this disclosure. Moreover, this disclosure contemplates that many users may use one computer 885, or that one user may use multiple computers 885.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A subsurface safety valve comprising:

an outer housing comprising an inner cylindrical surface;

a flapper valve disposed within the outer housing;

a motor that pivotally displaces the flapper valve;

a battery that powers the motor;

a turbine that charges the battery;

a wireless receiver that, responsive to a received signal, transmits a signal to the motor to pivotally displace the flapper valve;

the wireless receiver, the battery and the motor being mounted axially adjacent to one another within the outer housing and along the inner cylindrical surface;

the turbine being mounted at the inner cylindrical surface of the outer housing, axially spaced apart from the wireless receiver, the battery and the motor, wherein the wireless receiver, the battery and the motor are disposed axially between the turbine and the flapper valve; and a rotationally displaceable arm mounted at the motor and extending between the motor and the flapper valve, wherein the rotationally displaceable arm is driven by the motor in a manner to pivotally displace the flapper valve.

2. The valve according to claim 1, wherein the turbine also charges the wireless receiver.

3. The valve according to claim 2, wherein the turbine is powered via production flow through the subsurface safety valve.

4. The valve according to claim 3, further comprising a wired connection between the turbine and the wireless receiver and the battery, to permit the turbine to charge the wireless receiver and the battery.

5. The valve according to claim 4, wherein the wireless receiver transmits the signal to the motor responsive to a wireless signal from a well control system.

6. A method comprising:

providing a subsurface safety valve having an outer housing, the outer housing comprising an inner cylindrical surface;

disposing a flapper valve within the outer housing;

providing a motor, a battery, a turbine and a wireless receiver, wherein the wireless receiver, the battery and the motor are mounted axially adjacent to one another within the outer housing and along the inner cylindrical surface;

the turbine being mounted at the inner cylindrical surface of the outer housing, axially spaced apart from the wireless receiver, the battery and the motor;

the wireless receiver, the battery and the motor being disposed axially between the turbine and the flapper valve;

mounting a rotationally displaceable arm at the motor;

charging the battery with the turbine;

powering the motor with the battery;

receiving a signal at the wireless receiver; and responsive to the received signal, transmitting a signal to the motor to pivotally displace the flapper valve, wherein pivotally displacing the flapper valve comprises driving the rotationally displaceable arm with the motor.

7. The method according to claim 6, further comprising charging the wireless receiver with the turbine.

8. The method according to claim 7, further comprising powering the turbine is powered via production flow through the subsurface safety valve.

9. The method according to claim 8, further comprising a wired connection between the turbine and the wireless receiver and the battery, to permit the turbine to charge the wireless receiver and the battery.

10. The method according to claim 9, wherein the wireless receiver transmits the signal to the motor responsive to a wireless signal from a well control system.

* * * * *